US011466649B2

(12) United States Patent
Scamarcio et al.

(10) Patent No.: US 11,466,649 B2
(45) Date of Patent: Oct. 11, 2022

(54) PUMPING UNIT FOR FEEDING FUEL, PREFERABLY DIESEL FUEL, TO AN INTERNAL COMBUSTION ENGINE

(71) Applicant: Robert Bosch GmbH, Stuttgart (DE)

(72) Inventors: Antonio Scamarcio, Massafra (IT); Pietro De Carlo, Bitritto (IT)

(73) Assignee: Robert Bosch GmbH, Stuttgart (DE)

( * ) Notice: Subject to any disclaimer, the term of this patent is extended or adjusted under 35 U.S.C. 154(b) by 139 days.

(21) Appl. No.: 16/771,072

(22) PCT Filed: Nov. 19, 2018

(86) PCT No.: PCT/EP2018/081752
§ 371 (c)(1),
(2) Date: Jun. 9, 2020

(87) PCT Pub. No.: WO2019/115168
PCT Pub. Date: Jun. 20, 2019

(65) Prior Publication Data

US 2021/0164426 A1 Jun. 3, 2021

(30) Foreign Application Priority Data

Dec. 13, 2017 (IT) ..... 102017000143876

(51) Int. Cl.
*F02M 37/08* (2006.01)
*F02M 37/04* (2006.01)
(Continued)

(52) U.S. Cl.
CPC ..... *F02M 37/08* (2013.01); *F02M 37/041* (2013.01); *F04C 2/102* (2013.01);
(Continued)

(58) Field of Classification Search
CPC ..... F02M 37/08; F02M 59/12; F04C 2/00; F04C 2/084
(Continued)

(56) References Cited

U.S. PATENT DOCUMENTS 4,877,383 A 10/1989 White
5,364,246 A 11/1994 Frank et al.
(Continued)

FOREIGN PATENT DOCUMENTS

CN 1242824 A 1/2000
CN 1676915 A 10/2005
(Continued)

OTHER PUBLICATIONS

International Search Report for Application No. PCT/EP2018/081752 dated Jan. 2, 2019 (3 pages).

*Primary Examiner* — Logan M Kraft
*Assistant Examiner* — Joshua Campbell
(74) *Attorney, Agent, or Firm* — Michael Best & Friedrich LLP

(57) ABSTRACT

A pumping unit for feeding fuel, preferably diesel fuel, to an internal combustion engine has a pre-feed pump (3), which feeds the fuel to a high-pressure pump (2), is connected to a fuel storage chamber by means of an intake duct (49) and is provided with two gearings (40, 42) engaging with each other and made to rotate by an electric motor (37), a stator (38) of which is housed inside a containing chamber (48) formed in a pump body (32) of the pre-feed pump (3) and hydraulically connected to the intake duct (49).

10 Claims, 4 Drawing Sheets

(51) Int. Cl.
*F04C 2/10* (2006.01)
*F04B 53/14* (2006.01)
*F04B 53/16* (2006.01)

(52) U.S. Cl.
CPC ..... *F04B 53/14* (2013.01); *F04B 53/16* (2013.01); *F04C 2210/203* (2013.01)

(58) Field of Classification Search
USPC ..... 123/497
See application file for complete search history.

(56) References Cited

U.S. PATENT DOCUMENTS

| | | | | |
|---|---|---|---|---|
| 5,649,514 | A * | 7/1997 | Okada | F02M 37/50 123/514 |
| 2004/0179953 | A1 * | 9/2004 | Suzuki | F04C 11/001 417/310 |
| 2008/0034745 | A1 | 2/2008 | Bildstein et al. | |
| 2014/0169995 | A1 | 6/2014 | Sugihara et al. | |
| 2016/0238004 | A1 | 8/2016 | Charwot et al. | |

FOREIGN PATENT DOCUMENTS

| | | | | |
|---|---|---|---|---|
| CN | 1793652 | A | 6/2006 | |
| CN | 101855452 | A | 10/2010 | |
| CN | 102483059 | A | 5/2012 | |
| CN | 103511247 | A | 1/2014 | |
| CN | 103998785 | A | 8/2014 | |
| CN | 104204530 | A | 12/2014 | |
| CN | 206299494 | U | 7/2017 | |
| CN | 107234958 | A | 10/2017 | |
| EP | 3104011 | B1 * | 4/2020 | F04C 2/10 |
| JP | H089389 | Y2 * | 3/1996 | |
| WO | WO-2012028507 | A1 * | 3/2012 | F04B 1/0426 |
| WO | 2015074878 | | 5/2015 | |
| WO | 2017108470 | | 6/2017 | |

* cited by examiner

PUMPING UNIT FOR FEEDING FUEL, PREFERABLY DIESEL FUEL, TO AN INTERNAL COMBUSTION ENGINE

BACKGROUND OF THE INVENTION

The present invention relates to a pumping unit for feeding fuel, preferably diesel fuel, to an internal combustion engine.

In particular, the present invention relates to a pumping unit of the type comprising a piston pump for feeding the fuel to the internal combustion engine, and an electrically operated gear pump for feeding the fuel from a storage tank to the piston pump.

SUMMARY OF THE INVENTION

The piston pump comprises a pump body; at least one cylinder formed in the pump body; a piston slidably engaged inside the cylinder; and an actuating device for displacing the piston with an intake stroke for drawing the fuel into the cylinder and with a compression stroke for compressing the fuel contained inside the said cylinder.

The piston pump comprises furthermore an intake valve for selectively controlling feeding of the fuel into the cylinder; and a delivery valve for selectively controlling feeding of the fuel to the internal combustion engine.

The gear pump has a pump body comprising a cup-shaped body, which is bounded by an end wall, is also bounded by a side wall and is closed by a cover.

The cover is arranged in contact with the side wall and is connected in a fluid-tight manner to the cup-shaped body by means of an annular seal arranged in between.

The pump body houses internally an electric motor axially locked onto the cup-shaped body by means of a resilient ring arranged between the cover and the said electric motor.

The electric motor comprises a stator, a rotor rotatably engaged inside the stator, and an outer gearing formed on the rotor and provided with inner teeth.

The gear pump further comprises an inner gearing mounted inside the rotor and provided with outer teeth meshing with the inner teeth of the outer gearing.

The pump body is configured to define a first containing chamber for housing internally the two gearings and a second containing chamber for housing internally the stator.

The two sets of teeth are formed so as to define a plurality of variable-volume chambers which are connected together in a fluid-tight manner.

Following rotation of the rotor and the internal gearing about the corresponding axes of rotation, each variable-volume chamber is connected hydraulically in succession firstly to an intake duct for drawing the fuel into the gear pump and then to a delivery duct for feeding the fuel to the piston pump.

Since the pressure of the fuel inside the variable-volume chambers increases from the intake duct to the delivery duct, the fuel seeps between the pump body and the rotor and inside the second containing chamber owing to the axial play existing between the gearings and the said pump body.

The known pumping units of the type described above have a number of drawbacks which mainly arise from the fact that, owing to the increase in pressure generated inside the second containing chamber by the fuel seeping between the pump body and the rotor, the cup-shaped body and the cover of the pump body, the annular seal and the resilient ring are subject to relatively high stresses.

The known pumping units of the type described above have moreover the further drawback that, during normal operation, heating of the fuel inside the second containing chamber caused by heating of the stator prevents cooling of the stator, reducing the efficiency thereof, results in deterioration of the fuel and causes the deposition of the fuel on the stator itself.

The object of the present invention is to provide a pumping unit for feeding fuel, preferably diesel fuel, to an internal combustion engine which does not have the drawbacks mentioned above and which is simple and low-cost to produce.

According to the present invention a pumping unit for feeding fuel, preferably diesel fuel, to an internal combustion engine is provided, as claimed in the accompanying claims.

BRIEF DESCRIPTION OF THE DRAWINGS

The present invention will now be described with reference to the attached drawings which show a non-limiting example of embodiment thereof, in which.

DETAILED DESCRIPTION

Figure 1:
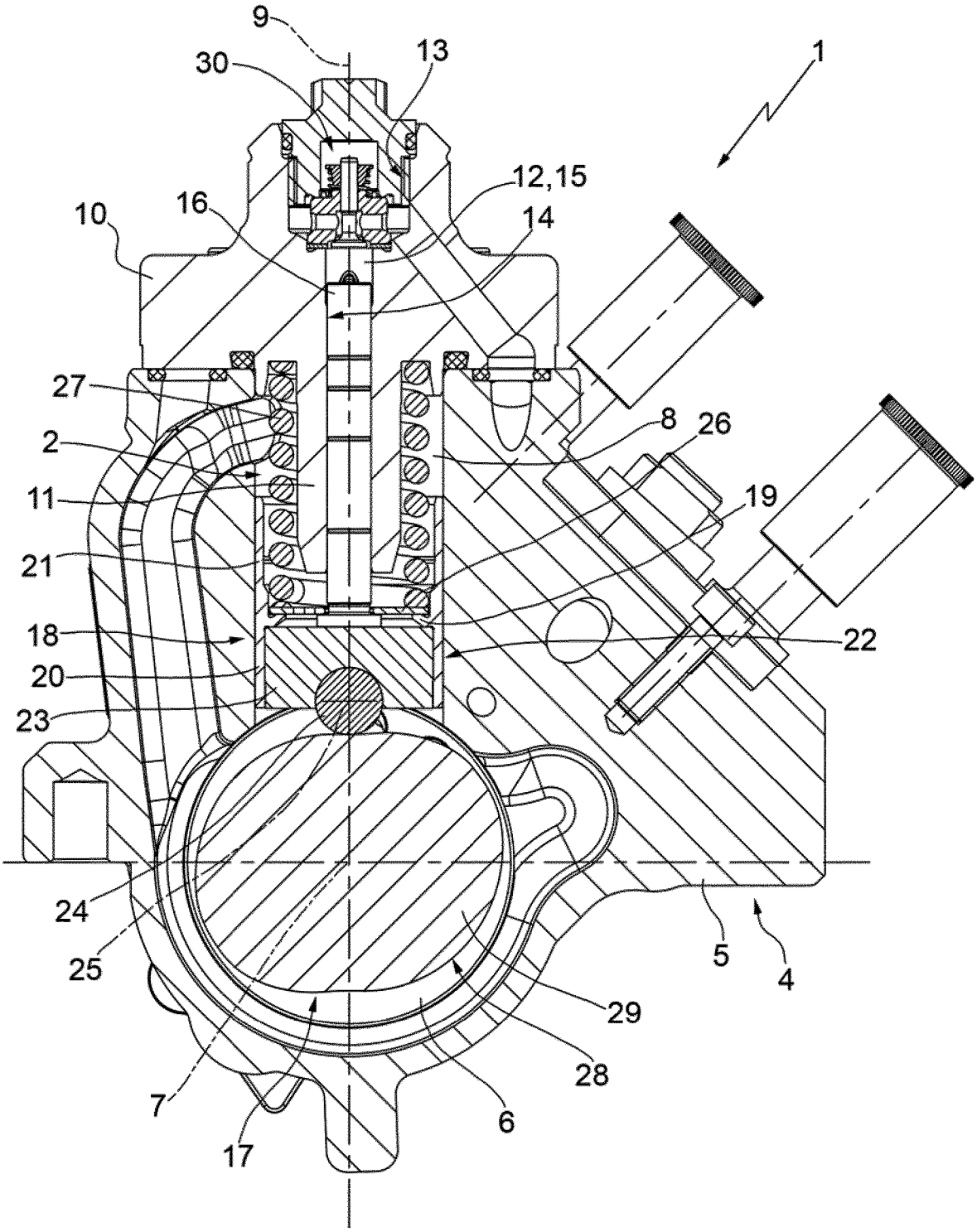
FIG. 1 is a first cross-sectioned schematic view, with parts removed for greater clarity, of a pumping unit.
Figure 2:
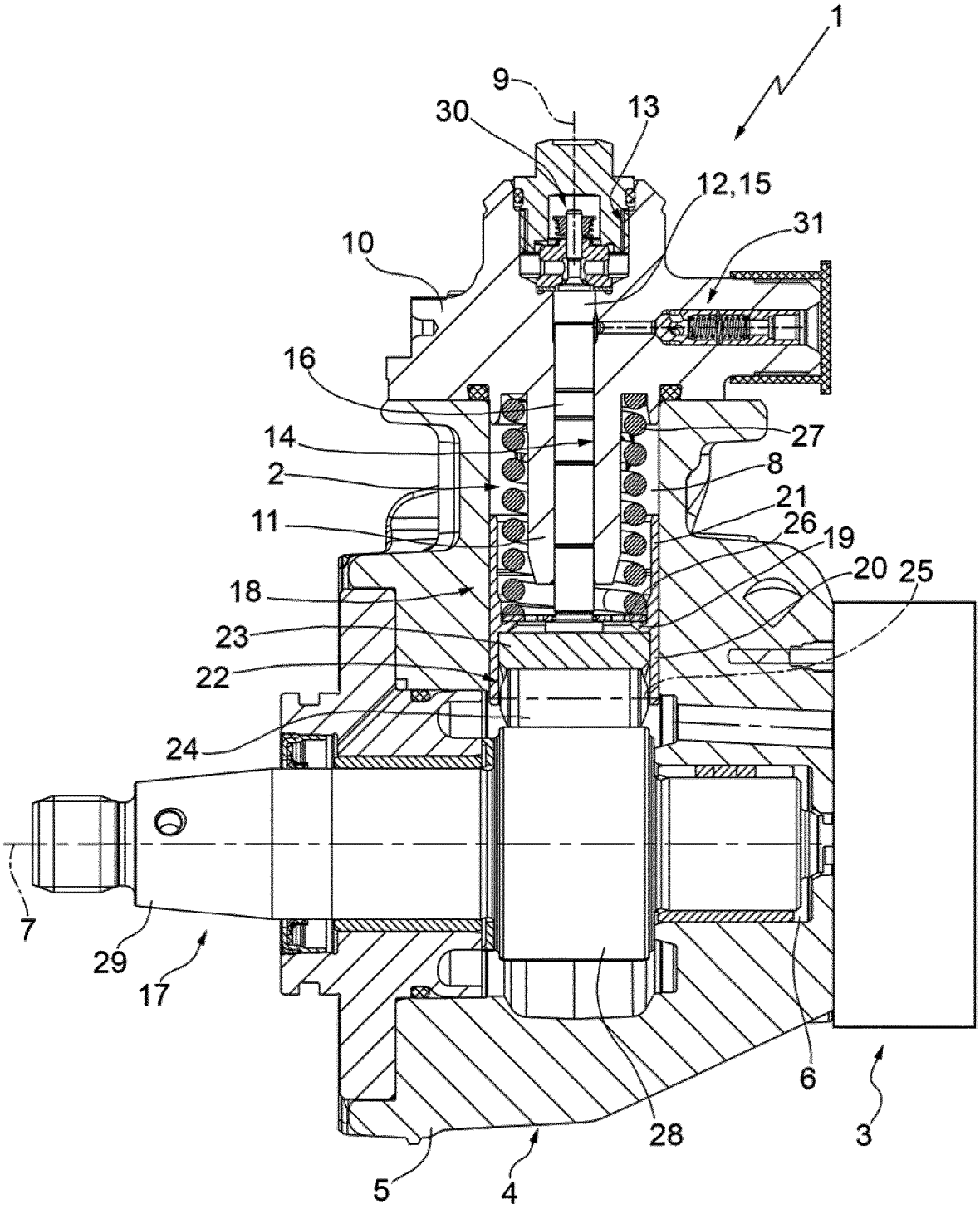
FIG. 2 is a second cross-sectioned schematic view, with parts removed for greater clarity, of the pumping unit according to FIG. 1.

With reference to FIGS. 1 and 2, reference numeral 1 denotes, in its entirety, a pumping unit for feeding fuel, preferably diesel fuel, from a storage tank (not shown) to an internal combustion engine (not shown), in this case a diesel combustion engine.

The pumping unit 1 comprises a high-pressure pump 2 for feeding the fuel to the internal combustion engine (not shown), and a low-pressure or pre-feed pump 3 for feeding the fuel from the storage tank (not shown) to the pump 2.

The high-pressure pump 2 is a piston pump provided with a pump body 4 comprising a containing casing 5 which has a central hole 6 with a longitudinal axis 7 and also has at least one side hole 8 (normally a plurality of holes 8 uniformly distributed around the axis 7) which has a longitudinal axis 9 transverse to the axis 7 and extends radially towards the outside of the casing 5 from the said hole 6.

Each hole 8 is closed by a head-piece 10 which is arranged in contact with the casing 5 and has a lug 11 projecting inside the hole 8 coaxially with the axis 9.

The head-piece 10 has a central hole 12 which is formed through the head-piece 10 coaxially with the axis 9 and comprises a wider portion 13 and a narrower portion 14 aligned with each other along the said axis 9.

The portion 14 faces the hole 6 and defines a cylinder 15 of the pump 2 slidably engaged by a piston 16 movable, under the thrust of an actuating device 17, with a rectilinear reciprocating movement comprising an intake stroke for drawing the fuel into the cylinder 15 and a compression stroke for compressing the fuel contained inside the said cylinder 15.

The device 17 comprises a tubular sleeve 18 which is slidably engaged inside the hole 8 coaxially with the axis 9, extends around the cylinder 15 and has an internal annular flange 19 which projects radially from an inner surface of the sleeve 18 and divides the sleeve 18 itself into two cylindrical portions 20, 21, the portion 20 of which faces the hole 6.

The device 17 also has a tappet assembly 22 comprising an engaging block 23 with a substantially cylindrical shape which is locked by means of interference inside the portion 20, is arranged in contact with the flange 19 and supports a tappet roller 24.

The roller 24 projects from the block 23 towards the hole 6 and is rotatably engaged with the block 23 so as to rotate, relative to the said block 23, about an associated longitudinal axis 25 substantially perpendicular to the axis 9.

The flange 19 supports an annular disc element 26 which extends around the piston 16, is inserted inside the portion 21 of the sleeve 18 coaxially with the axis 9 and has an outer perimetral edge axially facing the flange 19 and an inner perimetral edge axially facing a head of the said piston 16.

The device 17 further comprises a compression spring 27 which is mounted between the lug 11 and the sleeve 18 coaxially with the axis 9 and is arranged between the head-piece 10 and the disc element 26 so as to displace—and normally keep—the disc element 26 in contact with the flange 19 and the roller 24 in contact with a cam 28 formed on an outer surface of an intermediate portion of a transmission shaft 29 mounted through the hole 6 so as to rotate, relative to the casing 5, about the axis 7.

Feeding of the fuel inside each cylinder 15 is selectively controlled by a corresponding intake valve 30 of the known type, while feeding of the fuel from each cylinder 15 to the internal combustion engine (not shown) is selectively controlled by a corresponding delivery valve 31 of the known type.

Figure 3:
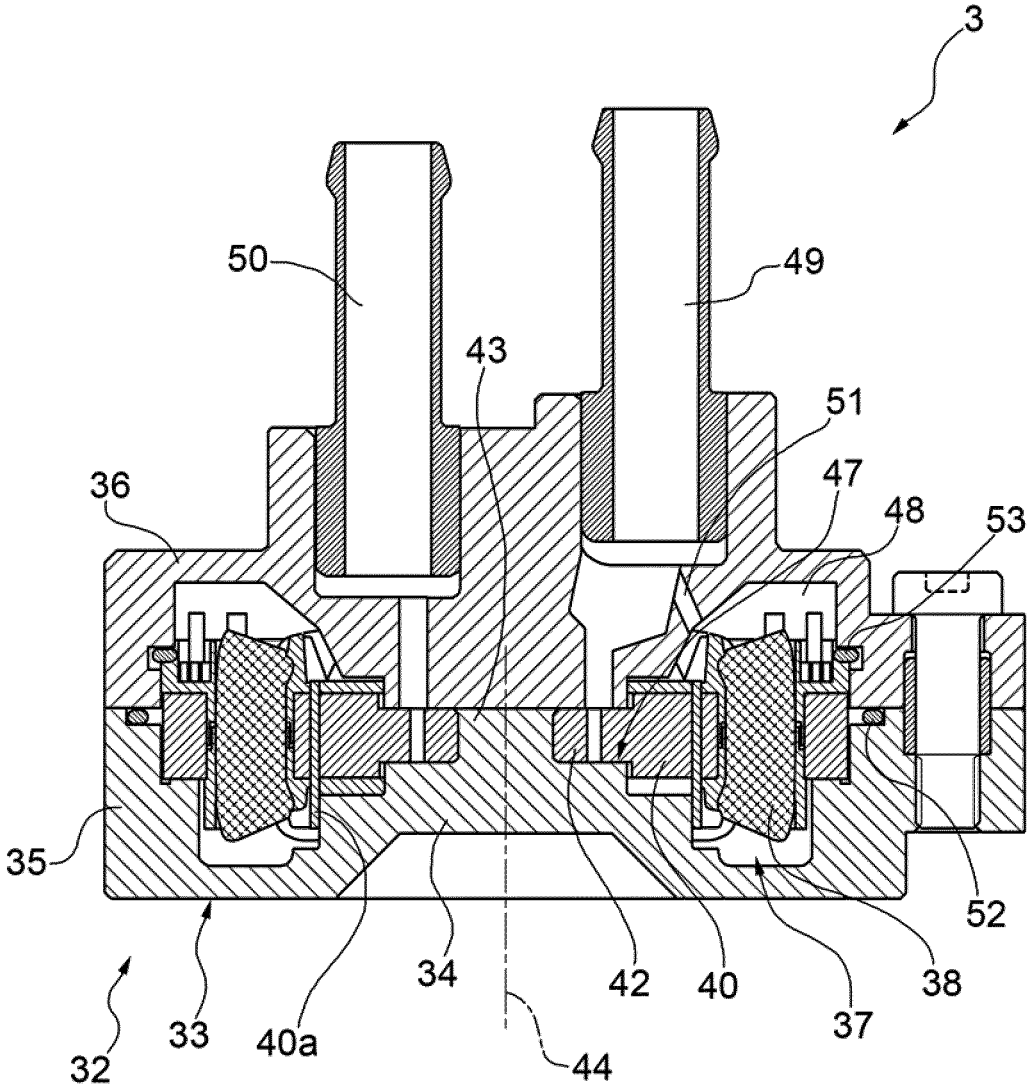
FIG. 3 is a cross-sectioned schematic view, with parts removed for greater clarity, of a detail of the pumping unit shown in FIGS. 1 and 2.
Figure 4:
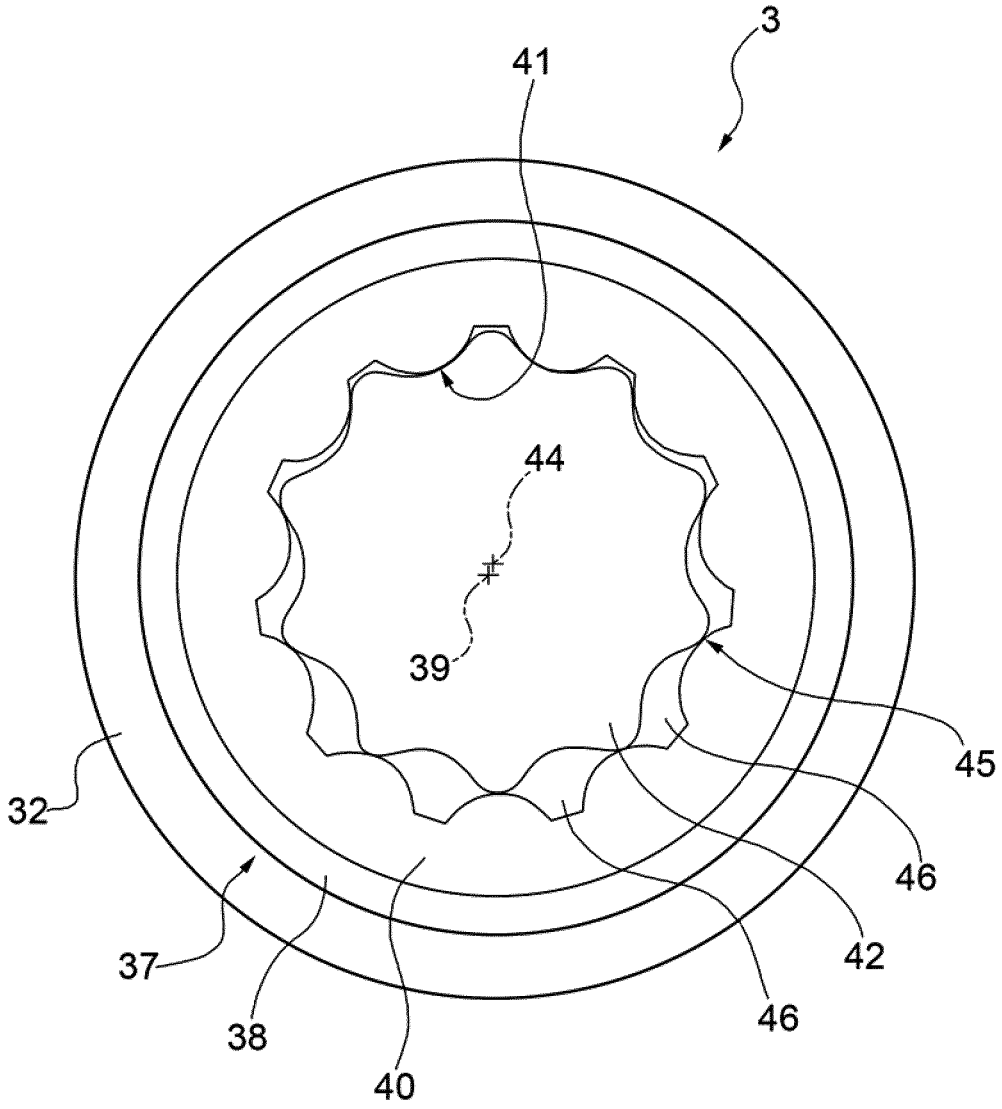
FIG. 4 is a schematic plan view, with parts removed for greater clarity, of the detail shown in FIG. 3.

With reference to FIGS. 3 and 4, the pump 3 is an electrically operated gear pump provided with a pump body 32 comprising a cup-shaped body 33 which is bounded by an end wall 34 and by a side wall 35 and is closed by a cover 36 arranged in contact with the said wall 35.

The pump 3 further comprises a synchronous, brushless, permanent-magnet electric motor 37 housed inside the pump body 32.

The motor 37 comprises a stator 38 with an annular shape which has a longitudinal axis 39 substantially perpendicular to the wall 34 and is slidably engaged by a rotor 40 with an annular shape by means of a bearing 40*a* arranged in between and coaxial with the said axis 39.

The rotor 40 is mounted coaxially with the axis 39, has inner teeth 41 and defines an outer gearing of the pump 3.

The pump 3 further comprises an inner gearing 42 which is housed inside the rotor 40 and is rotatably engaged with a centring pin 43 projecting from the wall 34 towards the cover 36.

The gearing 42 is mounted rotatably about an axis of rotation 44 parallel to, and separate from, the said axis 39 and has outer teeth 45 meshing with the inner teeth 41 of the rotor 40.

The two sets of teeth 41, 45 are formed so as to define a plurality of variable-volume chambers 46 which are distributed around the axis 39 and are connected to each other in a fluid-tight manner.

The cup-shaped body 33 and the cover 36 are formed so as to define two containing chambers 47, 48 which extend around the axis 39 and:

the chamber 47 of which houses internally the teeth 41 and 45 and has a height, measured parallel to the axis 39, substantially equal to a height of the chambers 46, also measured parallel to the axis 39; and the chamber 48 of which houses internally the stator 38.

Following rotation of the rotor 40 and the gearing 42 about the corresponding axes 39, 44, each chamber 46 is connected hydraulically in sequence firstly to an intake duct 49 for drawing the fuel into the pump 3 and then to a delivery duct 50 for feeding the fuel to the pump 2.

In connection with the above it should be pointed out that:

the volume of the chambers 46 diminishes during transfer from the duct 49 to the duct 50 and increases during transfer from the duct 50 to the duct 49; and the pressure of the fuel increases during transfer from the duct 49 to the duct 50 and results in seeping of the fuel firstly between the pump body 32 and the rotor 40 and then into the containing chamber 48.

Consequently the pressure of the fuel inside the chamber 48 is greater than the pressure of the fuel inside the duct 49.

The pump 3 is also provided with a connection duct 51 which is formed through the cover 36, connects together the chamber 48 containing the stator 38 and the intake duct 49 and allows recirculation inside the intake duct 49 of the fuel seeping between the pump body 32 and the rotor 40 into the said containing chamber 48.

The cup-shaped body 33 and the cover 36 are connected together in a fluid-tight manner by means of an annular seal 52 arranged in between and mounted coaxially with the axis 39.

The electric motor 37 is axially locked inside the pump body 32 by means of a resilient ring 53 mounted between the cover 36 and said electric motor 37 coaxially with the axis 39.

Owing to the presence of the connection duct 51 and the pressure of the fuel inside the chamber 48 the fuel seeping into the said chamber 48 may be recirculated inside the duct 49.

Owing to recirculation of the fuel from the chamber 48 into the duct 49 the pressure of the fuel inside the chamber 48 may be reduced and the stator 38 cooled.

The reduction in the pressure of the fuel inside the chamber 48 results in a relatively smaller amount of stress acting on the annular seal 52 and the resilient ring 53, a relatively smaller amount of stress acting on the cup-shaped body 33 and the cover 36, and the possibility of producing the cup-shaped body 33 and the cover 36 using relatively lightweight and low-cost materials.

Cooling of the stator 38 improves the electrical efficiency of the stator 38 and reduces the deterioration of the fuel.

What is claimed is:

1. A pumping unit for feeding fuel to an internal combustion engine, the pumping unit comprising a high-pressure pump (2) for feeding the fuel to the internal combustion engine; a pre-feed pump (3) for feeding the fuel from a storage tank to the high-pressure pump (2); an intake duct (49) for drawing the fuel into the pre-feed pump (3); and a delivery duct (50) for feeding the fuel from the pre-feed pump (3) to the high-pressure pump (2); the pre-feed pump (3) comprising an electric motor (37) comprising, in turn, a stator (38), a rotor rotatably engaged inside the stator (38), and a first gearing (40) formed on the rotor; a second gearing (42) engaged with the first gearing (40); and a pump body (32) configured to define a first containing chamber (47) for housing internally the first and second gearings (40, 42) and a second containing chamber (48) for housing internally the stator (38); wherein the first containing chamber (47) is fluidly connected to the intake duct (49) and is configured to deliver fuel to the delivery duct (50), wherein the pre-feed pump (3) further comprises a connection duct (51) formed through the pump body (32) so as to connect together the second containing chamber (48) and the intake duct (49) such that, during operation of the pre-feed pump, fuel that has seeped between the pump body (32) and the first and second gearings (40, 42) and moved from the first containing chamber (47) to the second containing chamber (48) is returned to the intake duct (49) upstream of the first containing chamber (47).

2. The pumping unit according to claim 1, wherein the pre-feed pump is configured such that, during operation of the pre-feed pump, a pressure of the fuel inside the second containing chamber (48) is greater than a pressure of the fuel inside the intake duct (49) so as to ensure the fuel that has seeped between the pump body (32) and the first and second gearings (40, 42) and moved from the first containing chamber (47) to the second containing chamber (48) is moved from the second containing chamber (48), through the connection duct (51), and returned to the intake duct (49).

3. The pumping unit according to claim 1, wherein the first gearing (40) is an outer gearing formed on the rotor and provided with inner teeth (41) and the second gearing (42) is an inner gearing mounted inside the first gearing (40) and provided with outer teeth (45).

4. The pumping unit according to claim 3, wherein the outer teeth (45) define, together with the inner teeth (41), a plurality of variable-volume chambers (46), each of which has, when situated opposite the intake duct (49), a first volume and, when situated opposite the delivery duct (50), a second volume smaller than the first volume.

5. The pumping unit according to claim 1, wherein the pump body (32) comprises a cup-shaped body (33) and a cover (36) for closing the cup-shaped body (33).

6. The pumping unit according to claim 5, wherein the pre-feed pump (3) further comprises an annular seal (52) for connecting together in a fluid-tight manner the cup-shaped body (33) and the closing cover (36).

7. The pumping unit according to claim 5, wherein the pre-feed pump (3) further comprises a resilient ring (53) arranged between the closing cover (36) and the electric motor (37) so as to axially lock the electric motor (37) on the cup-shaped body (33).

8. The pumping unit according to claim 1, wherein the first and second gearings (40, 42) are mounted so as to rotate about respective axes of rotation (39, 44) parallel to each other and separate from each other.

9. The pumping unit according to claim 8, wherein the first containing chamber (47) has a height, measured parallel to the axes of rotation (39, 44), substantially equal to a height of the first and second gearings (40, 42) also measured parallel to the axes of rotation (39, 44).

10. The pumping unit according to claim 1, wherein the high-pressure pump (6) is a piston pump comprising a pump body (4), at least one cylinder (15) formed in the pump body (4), a piston (16) slidably engaged inside the cylinder (15), and an actuating device (17) for displacing the piston (16) with an intake stroke for drawing the fuel into the cylinder (15) and with a compression stroke for compressing the fuel contained inside the cylinder (15).

* * * * *